US005526953A

United States Patent [19]

Chieng

[11] Patent Number: 5,526,953

[45] Date of Patent: Jun. 18, 1996

[54] PORTABLE BOX FOR CONTAINING V8 VIDEO TAPES

[76] Inventor: Walter Chieng, 1F, No. 12, Alley 18, Lane 277, Sec. 6 Chung Shan N. Rd., Taipei, Taiwan

[21] Appl. No.: 274,212

[22] Filed: Jul. 13, 1994

[30] Foreign Application Priority Data

May 24, 1994 [TW] Taiwan ..... 83207306
May 24, 1994 [TW] Taiwan ..... 83304200

[51] Int. Cl.[6] ..... A45C 11/00

[52] U.S. Cl. ..... 220/4.23; 220/523; 206/387.1; 206/387.15; 224/671

[58] Field of Search ..... 220/339, 378, 220/481, 523, 553, 555, 657, 4.22, 4.23; 206/387.1, 387.15; 224/252, 269

[56] References Cited

U.S. PATENT DOCUMENTS 3,405,836 10/1968 Regis, Jr. ..... 220/339 X
3,627,113 12/1971 DiIoia ..... 220/339 X
4,440,299 4/1984 Peinecke ..... 206/387.1
5,277,329 1/1994 Domroy et al. ..... 220/523 X
5,312,029 5/1994 Tuber ..... 224/252
5,353,946 10/1994 Behrend ..... 220/339 X
5,405,007 4/1995 Iwahashi ..... 206/387.1

*Primary Examiner*—Steven M. Pollard
*Attorney, Agent, or Firm*—Notaro & Michalos

[57] ABSTRACT

A portable box for containing V8 video tapes, comprising a substantially rectangular box body, a cover body corresponding to the box body and integrally connected therewith, a hanging hook disposed on a front face of the box body and a fastening hook disposed on a front face of the cover body. The box body has an upper edge formed with a horizontal frame section and a vertical frame section. The cover body has a lower edge which is formed with a horizontal frame section adapted to engage with the horizontal frame section of the box body to achieve waterproof and humidity-proof effect. A partitioning plate is disposed in the box body so as to partition the same into compartments for separately containing and confining the video tapes and avoid shaking thereof. The fastening hook is adapted to engage with the hanging hook and the hanging hook is adapted to hang on the waist or a belt of a user.

7 Claims, 8 Drawing Sheets

PORTABLE BOX FOR CONTAINING V8 VIDEO TAPES

BACKGROUND OF THE INVENTION

It is known that the video tape used in a current V8 video camera is smaller than a general video tape and is dimensioned substantially as a general audio tape. Such V8 video tape is contained in a plastic box or casing. The box or casing is often placed in a trip bag or other places when a user goes outdoors and is not portable so that when the user occasionally needs to use or replace the video tape, the user may be unable to use or replace the video tape in time and thus miss the desirable picture. Therefore, it is necessary to provide a portable box for containing the V8 video tape. Such portable box must be waterproof, humidityproof and easy to be hung on the user and permit the user to take out the video tape easily.

Several kinds of conventional portable boxes or bags are developed for containing tools, glasses and the like. Such portable boxes or bags are hung on the waist of a user. However, such products are not waterproof or humidityproof. Moreover, it is not considered where the gravity center of the box should be located and how to prevent the article contained in the box from replacing.

SUMMARY OF THE INVENTION

It is a primary object of the present invention to provide a portable box for containing V8 video tapes. The portable box enables a user to conveniently carry V8 video tapes with him/her and permits the user to easily take out the video tapes from the box. Moreover, the portable box is waterproof, humidityproof and dustproof so that the video tapes can be stored for a long time. In addition, the video tapes are confined in the box and prevented from shaking. Also, the box is stably hung on the waist or a belt of the user with the gravity center of the box kept in true position so that the box will not swing on the belt. The box also serves to store general audio tapes.

According to the above object, the portable box comprises a substantially rectangular box body, a cover body corresponding to the box body and integrall connected therewith, a hanging hook disposed on a front face of the box body and a fastening hook disposed on a front face of the cover body. The box body has an upper edge formed with a horizontal frame section and a vertical frame section. The horizontal frame section of the box body is formed with a surrounding groove in which a rubber ring is disposed in. The cover body has a lower edge which is formed with a horizontal frame section adapted to engage with the rubber ring of the box body achieve waterproof, humidityproof and dustproof effect. A partitioning plate is disposed in the box body so as to partition the same into compartments for separately containing and confining the video tapes and avoid shaking thereof. The hanging hook is substantially U-shaped, including two reverse U-shaped upper ends, two lateral wing plates horizontally extending from the upper ends and defining a space, two vertical rib plates connected under the wing plates for reinforcing the same, a transverse pressing lever connected between the upper ends, and a lower hook lever. The hanging hook exerts resiliently inward clamping force on the belt of the user so as to securely affixed on the belt. The fastening hook is V-shaped, including an inner plate and an outer plate longer than the inner plate. A transverse projecting latch strip having triangular cross-section and several transverse slideproof strips are formed on outer surface of the outer plate of the fastening hook. The reverse U-shaped upper ends of the hanging hook serve to keep the box in a horizontal and stable state without tilting forward keep the gravity center of the box in true position. When the cover body is engaged with the box body, the fastening hook is inserted into the space between the wing plates of the hanging hook. At this time, the latch strip of the fastening hook slides over the pressing lever and engages therewith to achieve a latching effect. Because the fastening hook itself tends to resiliently stretch outward, the latch strip is securely locked under the pressing lever without detaching therefrom.

The present invention can be best understood through the following description and accompanying drawings, wherein:

DETAILED DESCRIPTION OF THE PREFERRED EMBODIMENTS

Figure 1:
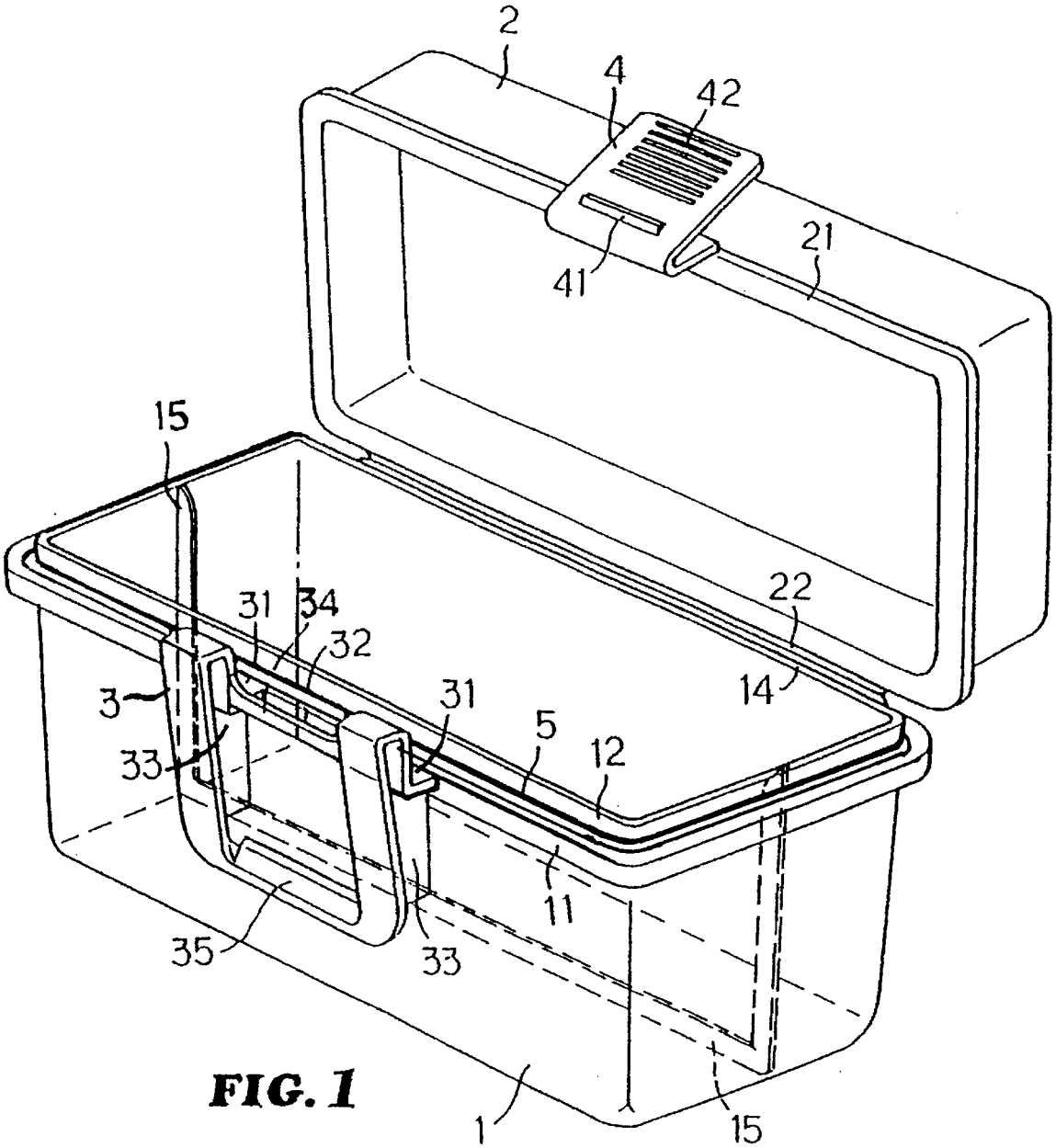
FIG. 1 is a perspective view of the present invention in an open state.

Please refer to FIG. 1. The portable box of the present invention includes a rectangular box body 1, a corresponding cover body 2, a hanging hook 3 disposed on a front side of the box body 1 and a fastening hook 4 disposed on a front side of the cover body 2. Each component of the portable box is made of plastic material by integral injection molding.

Figure 2:
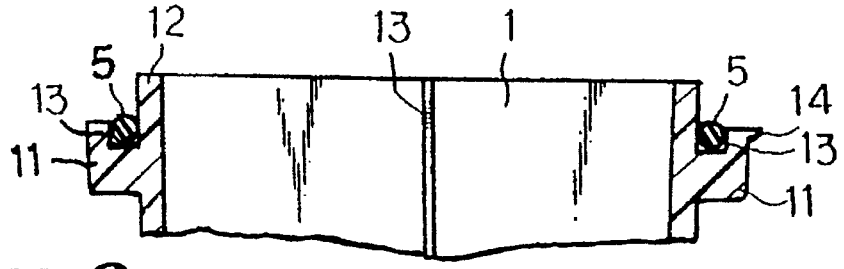
FIG. 2 is a sectional view of the upper edge of the box body of the present invention.

The box body 1 has an upper edge formed with a horizontal frame section 11 and a vertical frame section 12. The horizontal frame section 11 is formed with a surrounding groove 13 as shown in FIG. 2. A rubber ring 5 is disposed in the surrounding groove 13. On the other hand, the cover body 2 has a lower edge formed with a horizontal frame section 21 which is adapted to sealedly engage with the horizontal frame section 11 of the box body 1. The cover body 2 is integrally connected with the box body 1 by connecting rims 22, 14. A U-shaped partitioning plate 15 is disposed in the box body 1 for separating the video tapes. In FIG. 1, only one partitioning plate 15 is shown. However, two or more such partitioning plates 15 can be disposed in the box body 1 as necessary.

The hanging hook 3 is substantially U-shaped, including two reverse U-shaped upper ends 3A, two lateral wing plates 31 horizontally extending from the upper ends and defining a space 32, two vertical rib plates 33 connected under the wing plates 31 for reinforcing the same, a transverse pressing lever 34 connected between the upper ends and a lower hook lever 35.

The fastening hook 4 of the cover body 2 is V-shaped, including an inner plate and an outer plate 4A longer than the inner plate. A transverse projecting latch strip 41 having triangular cross-section is formed on a lower portion of the surface of the outer plate of the fastening hook 4 and several transverse slideproof strips 42 are formed on an upper portion thereof.

Figure 3:
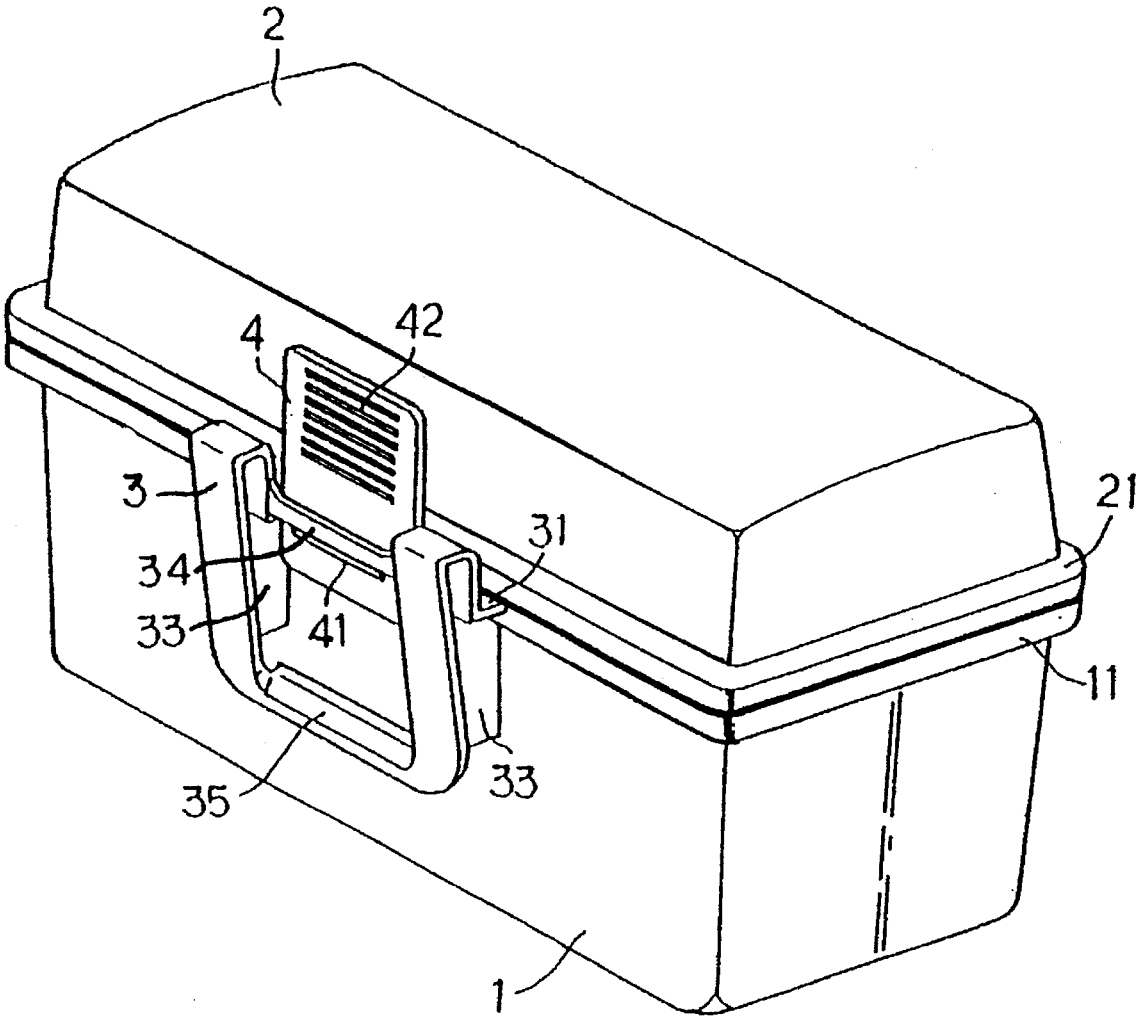
FIG. 3 is a perspective view of the present invention in a close state.
Figure 4:
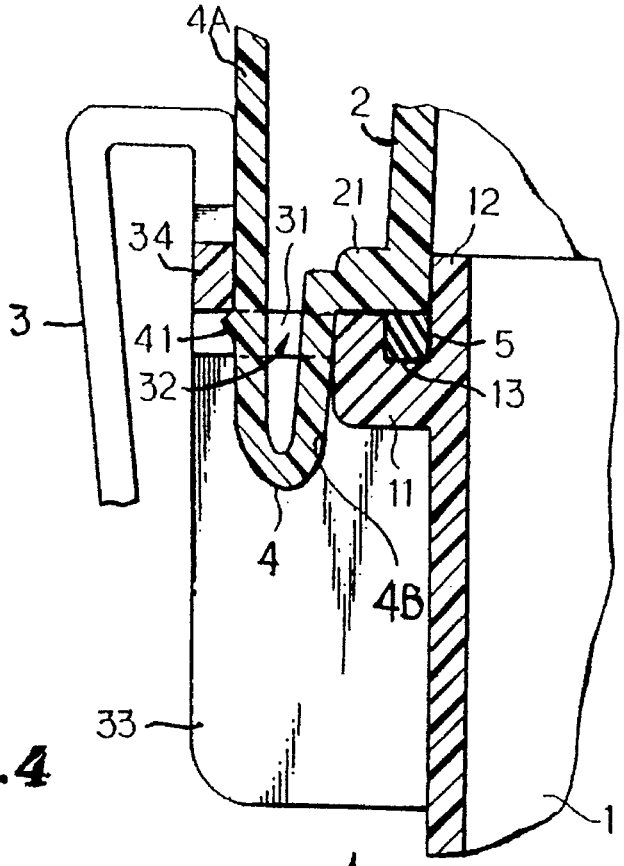
FIG. 4 is a sectional view showing that the hanging hook and fastening hook are engaged with each other.
Figure 5:
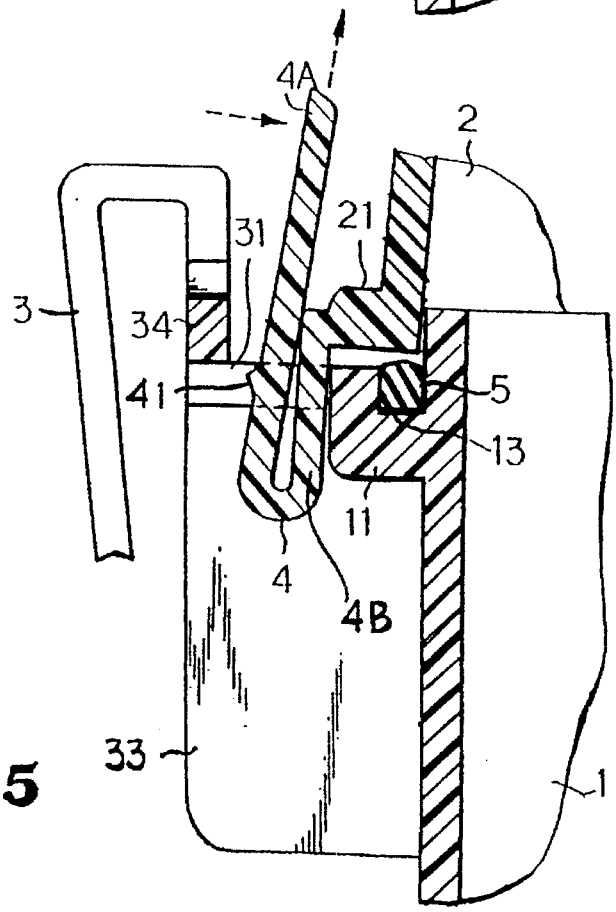
FIG. 5 is a sectional view according to FIG. 4, showing that the hanging hook is disengaged from the fastening hook.

Please refer to FIGS. 3, 4 and 50 When the cover body 2 is engaged with the box body 1, the fastening hook 4 is inserted into the space 32 between the wing plates 31 of the hanging hook 3. At this time, the latch strip 41 of the fastening hook 4 slides over the pressing lever 34 and engages therewith to achieve a latching effect as shown in FIG. 4. Because the fastening hook 4 itself tends to resiliently stretch outward, the latch strip 41 is securely locked under the pressing lever 34 without detaching therefrom. When it is desired to separate the fastening hook 4 from the hanging hook 3, the user only needs to press the outer plate 4A inward so as to disengage the latch strip 41 from the pressing lever 34 as shown in FIG. 5. At this time, the cover body 2 is permitted to be pulled upward into an open state.

Figure 8:
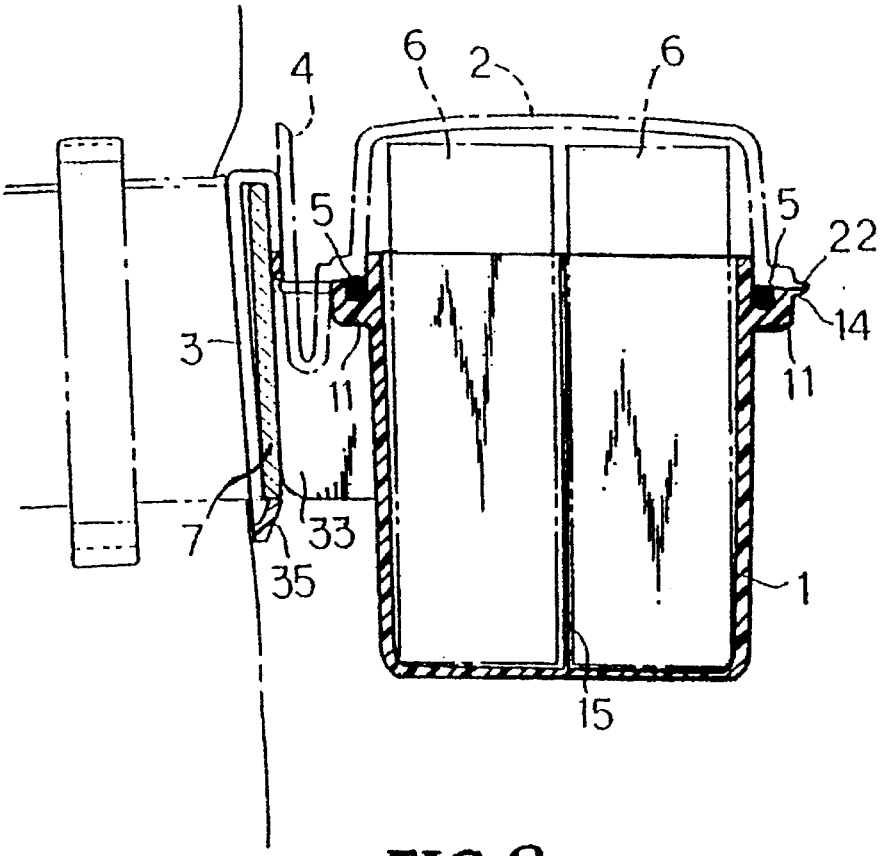
FIG. 8 shows that the portable box of the present invention is hung on a belt of a user.

Please refer to FIG. 8, wherein two video tapes 6 shown by phantom lines ) are placed in the portable box and separated as well as confined by the partitioning plate 15 in the box body 1 so that the video tapes 6 will not displace or shake in the box body.

Figure 7:
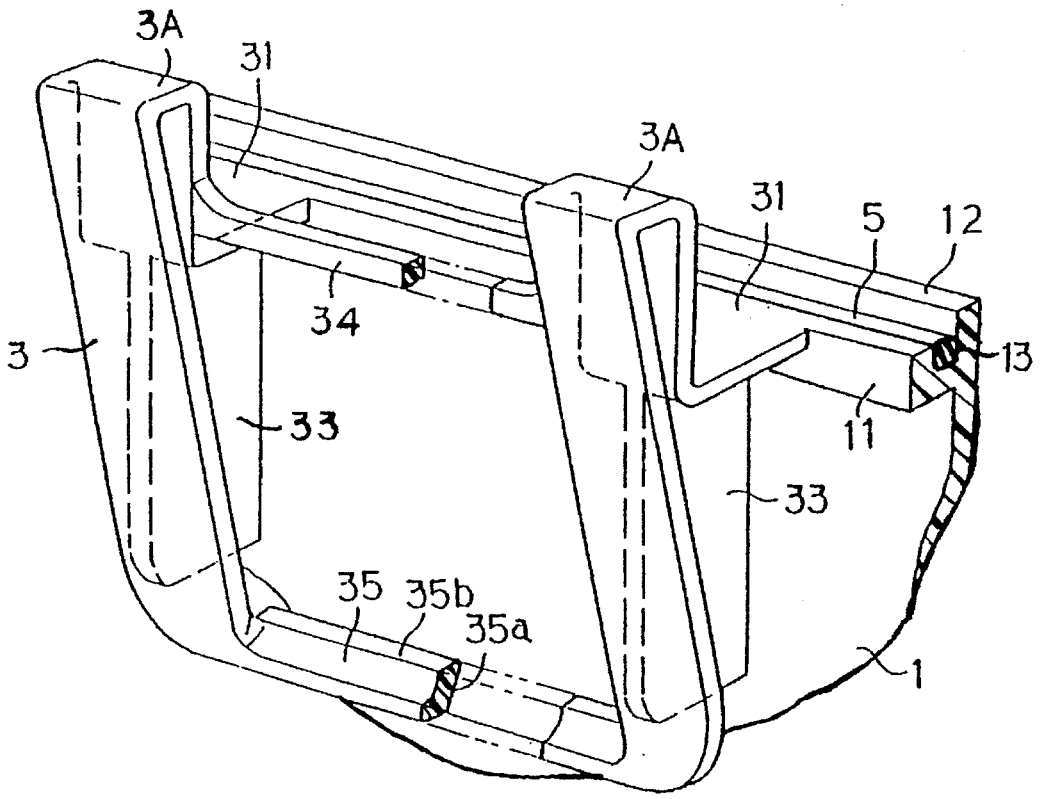
FIG. 7 is a perspective view of the hanging hook of the present invention.

Please refer to FIG. 7. The reverse U-shaped upper ends 3A of the hanging hook 3 serve to keep the box body 1 in a horizontal and stable state without tilting forward. As shown in FIG. 8, when the hanging hook 3 is hung on a belt 7 of the user, the video tapes 6 and the belt 7 are positioned substantially on the same level. If the hanging hook 3 were designed without the reverse U-shaped upper ends 3A, the belt and the box body 1 would positioned on the same level and the gravity center of the whole box would make the box tilt downward. In order to ensure that the box is horizontally positioned, the rib plates 33 serve to support the box and keep the gravity center thereof in true position.

Figure 6:
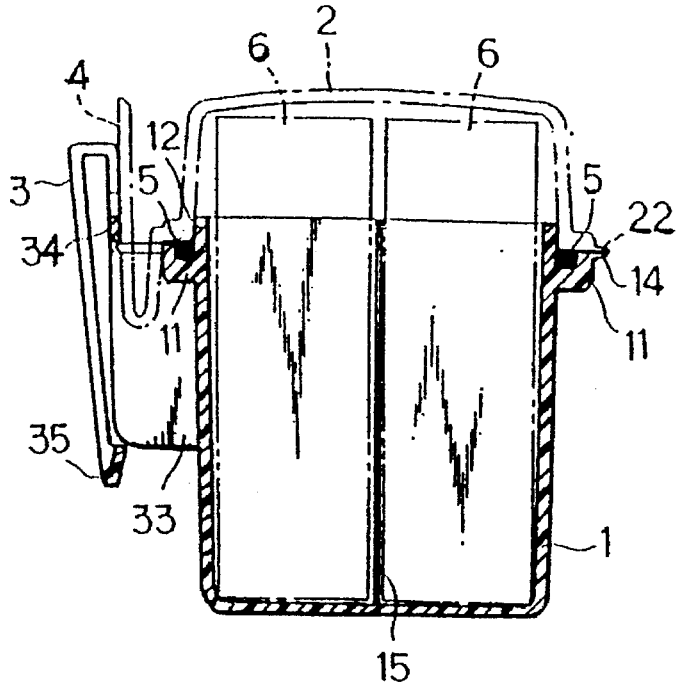
FIG. 6 is a sectional view of the present invention.

Please refer back to FIGS. 6 and 7. The transverse hook lever 35 of the hanging hook 3 includes an inward protecting hook section having an inner slant face 35*a* and an upper horizontal face 35*b*. The slant face facilitates the sliding of the hook lever 35 through the belt 7 and the horizontal face 35*b* abuts against a lower edge of the belt 7 and prevents the box from swinging on the belt 7. In addition, the hanging hook exerts inward resiliently clamping force on the belt 7 so as to tightly secure with the belt 7.

Figure 9:
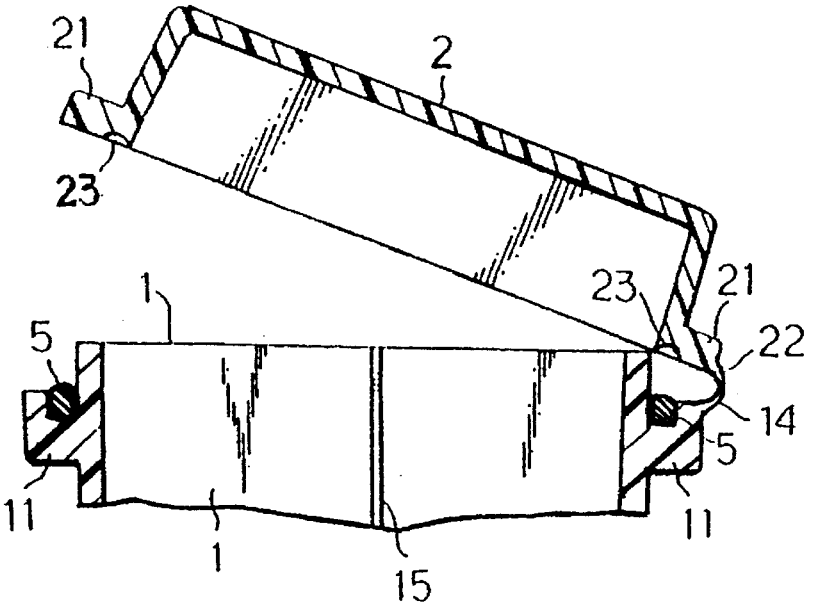
FIG. 9 shows another embodiment of the upper edge of the box body of the present invention.
Figure 10:
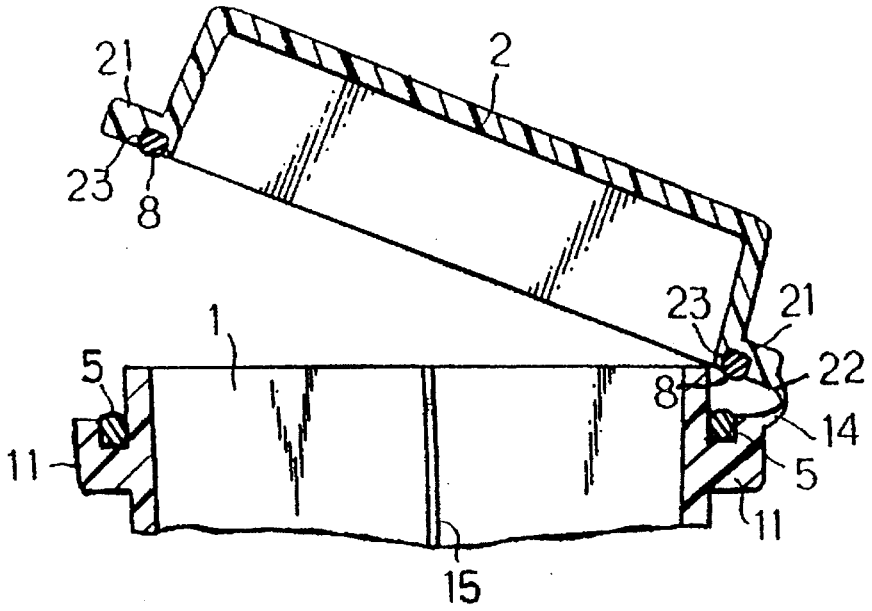
FIG. 10 shows still another embodiment of the upper edge of the box body of the present invention.
Figure 11:
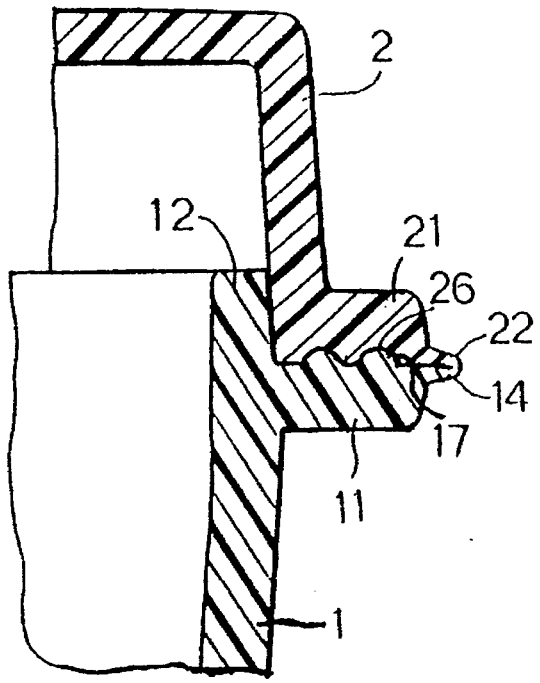
FIG. 11 shows another embodiment of the frame sections of the cover body and the box body.
Figure 12:
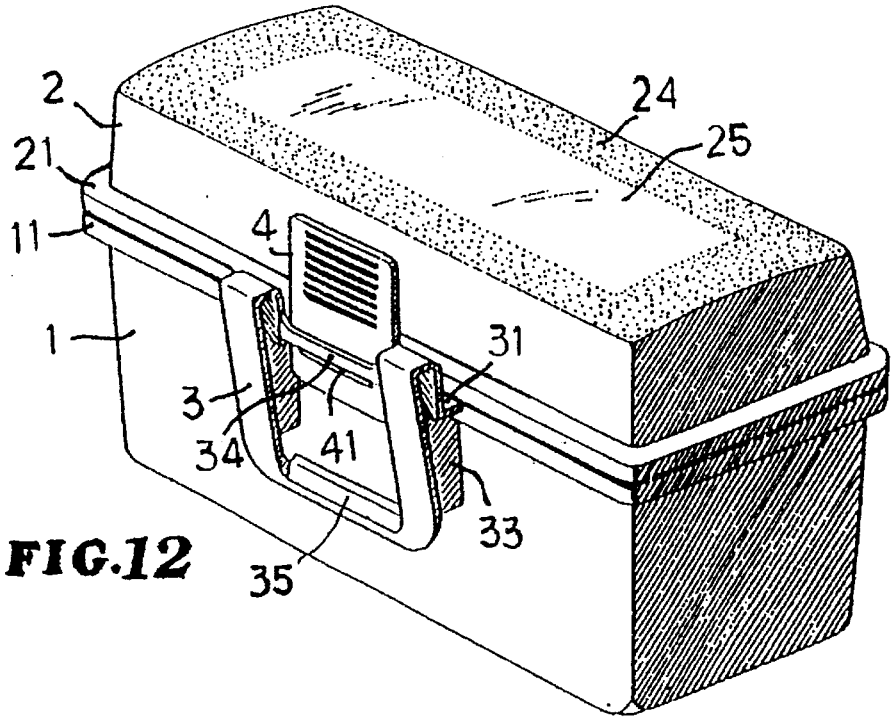
FIG. 12 shows another embodiment of the present invention wherein the cover body is engaged with the box body.

FIG. 9 shows a variation from the embodiment of FIG. 1, wherein the lower edge of the cover body 2 is formed with a surrounding groove 23 which is adapted to engage with the rubber ring 5 of the box body 1 so as to achieve waterproof and humidityproof effect. In addition, as shown in FIG. 10, a rubber ring 8 is disposed in the groove 23 of the cover body 2 so as to abut against the rubber ring 5 of the box body 1 for achieving waterproof and humidityproof effect. Alternatively, as shown in FIG. 11, the frame section 21 of the cover body 2 is formed with two surrounding grooves 26 (or surrounding projections) and the horizontal frame section 11 of the box body 1 is formed with two corresponding surrounding projections 17 (or surrounding grooves), whereby the projections 17 are engaged with the grooves 26 to achieve waterproof and humidityproof effect. Moreover, the box of the present invention can be made of transparent or semitransparent plastic material by integral injection molding. Alternatively, the cover body 2 is polished into a transparent state or, as shown in FIG. 12, the periphery 24 of the cover body 2 is obscured while the central portion 25 of the cover body 2 is transparent so that the user is able to see the video tapes inside the box through the transparent central portion 25.

Figure 13:
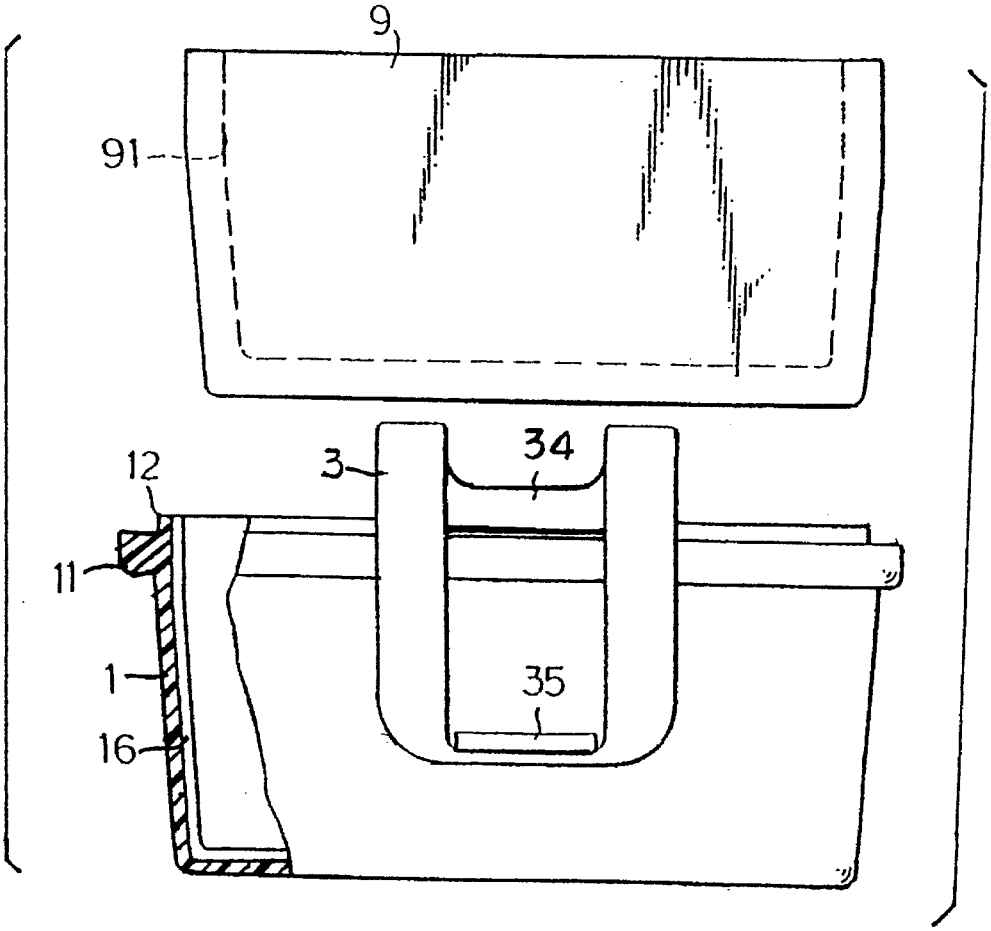
FIG. 13 shows another embodiment of the box body and partitioning plate of the present invention.

Furthermore, as shown in FIG. 13, the partitioning plate 9 can be a removable substantially rectangular plate body or a reverse U-shaped member as shown by phantom line 91 of FIG. 13. Cooperatively, a channel 16 is formed in the box body 1 for inserting the partitioning plate 9 thereinto so as to partition the interior of the box body 1.

Figure 14:
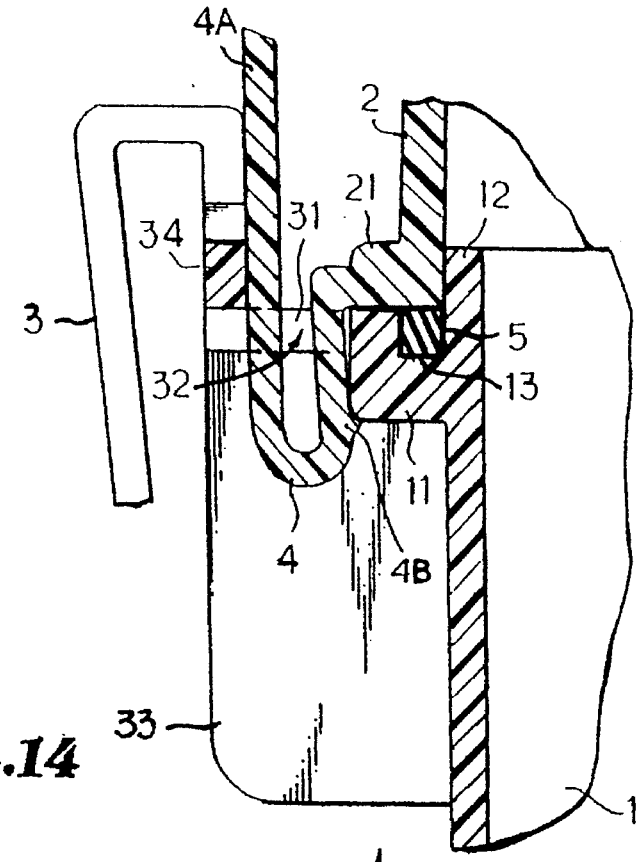
FIGS. 14 and 15 show another embodiment of the fastening hook of the present invention.
Figure 15:
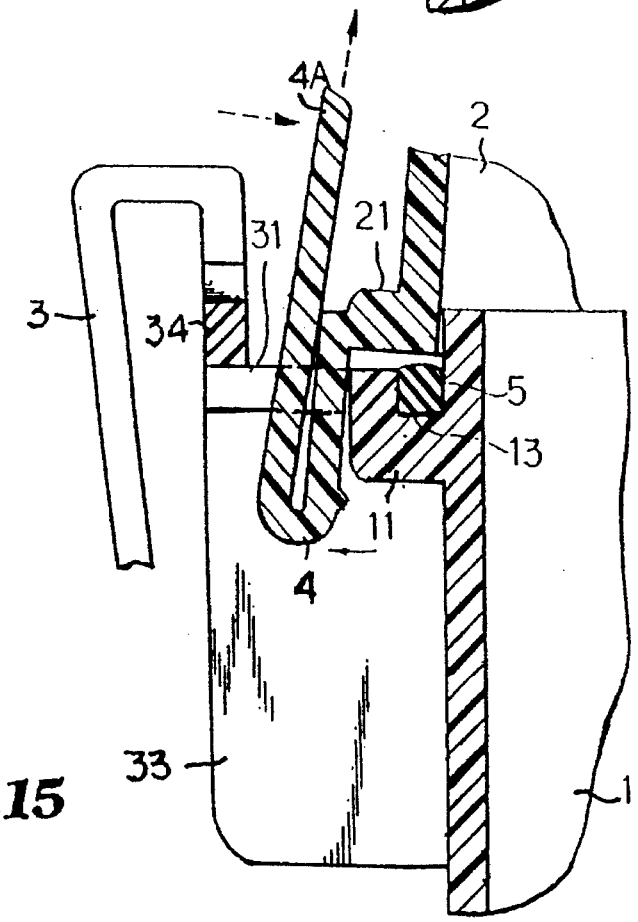

Please refer to FIGS. 14 and 15. The latch strip 41 of the fastening hook 4 can be alternatively disposed on inner face of the inner plate 4B, whereby when the cover body 2 is engaged with the box body 1, the latch strip 41 abuts against the horizontal frame section 11 of the box body 1 and is locked thereby. When it is desired to open the box, the user only needs to press the outer plate 4A inward so as to separate the latch strip 41 from the horizontal frame section 11.

The above embodiments are only examples of the present invention and any derivation or modification thereof should fall within the scope of the present invention.

What is claimed is:

1. A portable box for containing V8 video tapes, comprising:

a substantially rectangular box body having an upper edge which is formed with a horizontal frame section and a vertical frame section;

a substantially rectangular cover body corresponding to said box body and integrally connected therewith by a rear connecting rim, said cover body having a lower edge which is formed with a horizontal frame section adapted to engage with said horizontal frame section of said box body;

a hanging hook integrally connected with a front face of said box body; and a fastening hook integrally connected with a front face of said cover body for engaging with said hanging hook, said portable box being adapted to be hung on the waist or a belt of a user and characterized in that:

said horizontal frame section of said box body is formed with a surrounding groove in which a rubber ring is inserted, and at least one partitioning plate is disposed in said box body so as to partition said box body into compartments for separately containing said video tapes, said hanging hook being substantially U-shaped, including two reverse U-shaped upper ends, two lateral wing plates horizontally extending from said upper ends and defining a space, two vertical rib plates connected under said wing plates for reinforcing the same, a transverse pressing lever connected between said upper ends, and a lower hook lever, said hanging hook exerting resiliently inward clamping force on the belt of the user so as to securely affixed on the belt; and said fastening hook of said cover body is V-shaped, including an inner plate and an outer plate longer than said inner plate, a transverse projecting latch strip having triangular cross-section and several transverse slideproof strips being formed on outer surface of said outer plate of said fastening hook.

2. A portable box as claimed in claim 1, wherein more than one partitioning plate is disposed in said box body.

3. A portable box as claimed in claim 1, wherein said horizontal frame section of said cover body is formed with a surrounding groove in which said rubber ring of said box body is inserted so as to achieve waterproof and humidityproof effect.

4. A portable box as claimed in claim 1, wherein said horizontal frame section of said cover body is formed with a surrounding groove in which a rubber ring is inserted, said rubber ring of said cover body being tightly engaged with said rubber ring of said box body so as to achieve waterproof and humidityproof effect.

5. A portable box as claimed in claim 1, wherein said horizontal frame section of said cover body is formed with two surrounding grooves or projections and said horizontal frame section of said box body is formed with two surrounding projections or grooves engaged with said grooves or projections of said cover body so as to achieve waterproof and humidityproof effect.

6. A portable box as claimed in claim 1, wherein said latch strip of said fastening hook is transversely disposed on inner face of said inner plate of said fastening hook so as to engage with said horizontal frame section of said box body.

7. A portable box as claimed in claim 1, wherein a channel is disposed in said box body and said partitioning plate is substantially rectangular or U-shaped and removably inserted in said channel.

* * * * *